US006217495B1

(12) United States Patent
Yalch

(10) Patent No.: US 6,217,495 B1
(45) Date of Patent: Apr. 17, 2001

(54) SYMMETRICAL EXERCISE APPARATUS

(76) Inventor: Theodore Yalch, 20072 CR 4126, Lindale, TX (US) 75771

( * ) Notice: Subject to any disclaimer, the term of this patent is extended or adjusted under 35 U.S.C. 154(b) by 0 days.

(21) Appl. No.: 09/300,945

(22) Filed: Apr. 28, 1999

Related U.S. Application Data

(63) Continuation-in-part of application No. 08/176,920, filed on Jan. 3, 1994, now Pat. No. 5,897,469.

(51) Int. Cl.[7] ..... A63B 21/06; A63B 69/36
(52) U.S. Cl. ..... 482/109; 473/256; 482/106
(58) Field of Search ..... 482/92, 93, 106–109, 482/121, 122, 124, 126; 473/219, 256

(56) References Cited

U.S. PATENT DOCUMENTS 3,820,781 * 6/1974 Kane ..... 482/93
4,518,162 * 5/1985 Oates ..... 482/93
4,538,806 * 9/1985 Wilkerson ..... 482/108
5,026,063 * 6/1991 Rhodes ..... 473/256
5,083,790 * 1/1992 Wheatley ..... 482/109
5,135,455 * 8/1992 King et al. ..... 482/108

* cited by examiner

*Primary Examiner*—John Mulcahy
(74) *Attorney, Agent, or Firm*—Robert Nisbett

(57) ABSTRACT

A symmetrical exercise bar is produced having a high radius of gyration for a given total weight with the center of percussion in the distal hand-grip when the exercise bar is rotated like a golf club using a two hand grip. The exercise bar has a light weight high flexure strength middle section for optimum resistance in upper torso exercises of the arms, shoulders, neck, back and waist. The exercise bar has two weights attached to the middle section covered by hand-grips adapted for holding with two hands and adapted for use over the shoulders and neck.

9 Claims, 1 Drawing Sheet

SYMMETRICAL EXERCISE APPARATUS

RELATED APPLICATIONS

This application is a continuation-part of U.S. patent application Ser. No. 08/176,920 filed Jan. 3, 1994, now U.S. Pat. No. 5,897,469.

PRIOR ART

Exercise apparatus known in the prior art include devices to provide rigid bars for bending, twisting and stretching exercises as well as for swinging exercises and fashioned to simulate tennis racket, baseball bats, golf clubs and exercise bars.

U.S. Pat. No. 5,121,925 to Blundo describes a golf swing training apparatus which has a short bent shaft with several rotatable weights mounted on one end and a golf grip on the other.

U.S. Pat. No. 4,770,414 to Frederickson et.al. describes an exercise bar having a padded middle and turned down handles for bending and twisting exercises.

U.S. Pat. No. 5,083,790 to Wheatley describes a golf training stick having a hand grip and a tubular member having a weight from 1.25 to 5 pounds.

U.S. Pat. No. 4,555,111 to Alvarez describes a practice bat having a handle with one weighted end attached by a resilient spring.

U.S. Pat. No. 4,535,991 to Boatright describes a isometric golf trainer which consists of a golf club shaft with an elongated head having a series of holes for attaching a cord to the end of the golf shaft for isometric exercise.

U.S. Pat. No. 4,518,162 to Oates describes a cylindrical exercise bar having a quick release connection in the middle so that the bar can be broken down for transportation.

U.S. Pat. No. 4,440,391 to Seanx describes an exercise device which is a bar with two coupling joints so that the bar can be broken down into three sections.

U.S. Pat. No. 4,249,729 to Gabrielidis describes a tennis exercise aid which has a coil spring in the middle and different type handles on each end.

U.S. Pat. No. 3,588,102 to Gifford describes an exercise bar for attaching weights which have handles at each end attached by universal joints.

U.S. Pat. No. 3,231,281 to Wallo describes a weighted tubular practice golf club made of pipe and weighing 3 to 5 pounds.

U.S. Pat. No. 3,006,646 to Nanni describes a tubular exercising device having a sliding weight inside.

U.S. Pat. No. 3,428,325 to Atkinson describes a golf swing training device which has a soft cylindrical weight of 2½ to 3 ounces attached by an elastic cord to a handle.

U.S. Pat. No. 3,416,803 to Batista describes a golf swing training device which has a bag attached to a handle with the bag designed to capture a golf ball and direct it upward so that the golfer can catch the ball after he scoops it up with the bag.

U.S. Pat. No. 1,930,342 to Graham describes a golf practice club having a pear shaped weight attached by a chain to a shore golf club handle.

U.S. Pat. No. 1,385,642 to Restein describes a toy having rubber balls attached to each end of a stick.

U.S. Design Pat. No. 282,477 to Estevez describes an exerciser having a sphere attached to one end of a shaft with a heart shaped handle attached to the other end.

International Patent Application number PCT/US 89/01145 describes a resilient exercise apparatus having a fiber glass-resin rod with rectangular cross-section and a rubber sheath and handles at each end which is used for bending to exercise.

SUMMARY OF INVENTION

This invention provides an exercise apparatus which can be used for exercise or for warming-up before play by a golfer. Although the apparatus is most advantageous for a golfer, it can be used for general exercise and for other sports. The apparatus has a particular shape, weight distribution and selected total weight to allow the golfer to use the apparatus prior to play both to loosen and strengthen the neck, shoulders, arms, back, legs, waist and the torso generally by placing the apparatus behind the neck and across the shoulders. In this position the apparatus can be flexed forward and downward for benefit to the neck and shoulder muscles. By rotating the upper body with the apparatus across the shoulders, the waist and back muscles can be loosened and strengthened. The apparatus can be gripped at either end and swung as a golf club. The total weight and distribution of the weight can help stretch, loosen and strengthen the body and muscles to improve the golf game with these exercises and the apparatus can be used in similar fashion for any athlete.

The apparatus comprises a generally cylindrical rod or shaft at the middle having a high flexure modulus so that the shaft resists bending and works the body muscles as the shaft is bent during exercise. At each end of the shaft extended hand-grips allows for holding the apparatus by either or both ends. Within the hand-grips weights of high density materials are located and shaped to give the apparatus proper balance for both torso exercises and swinging exercises as described herein. The upper torso exercises loosen, extend and strengthen the muscles of the arms, neck, back, legs and upper body which are used extensively for playing golf. These exercises improve timing, balance grip, strength and the golf swing itself. The weights can be selected to give the effect of one or many golf clubs, thereby improving the golfers' control of any playing club. The weights are located in a position on the apparatus to give the proper swing mechanics of the apparatus during the swinging exercises. The total weight is selected for both the swinging exercise, strength and torso exercises. The flexure strength of the middle section or shaft is selected to give the desired resistance for the upper torso and strength exercises, especially for the upper arms and shoulder pulls.

One arrangement of the apparatus produces an exercise apparatus symmetrical both in proportion and weight distribution about its major or central axis and about a plane perpendicular to the center axis of the shaft and the major axis of the shaft.

DESCRIPTION OF THE INVENTION

Figure 1:
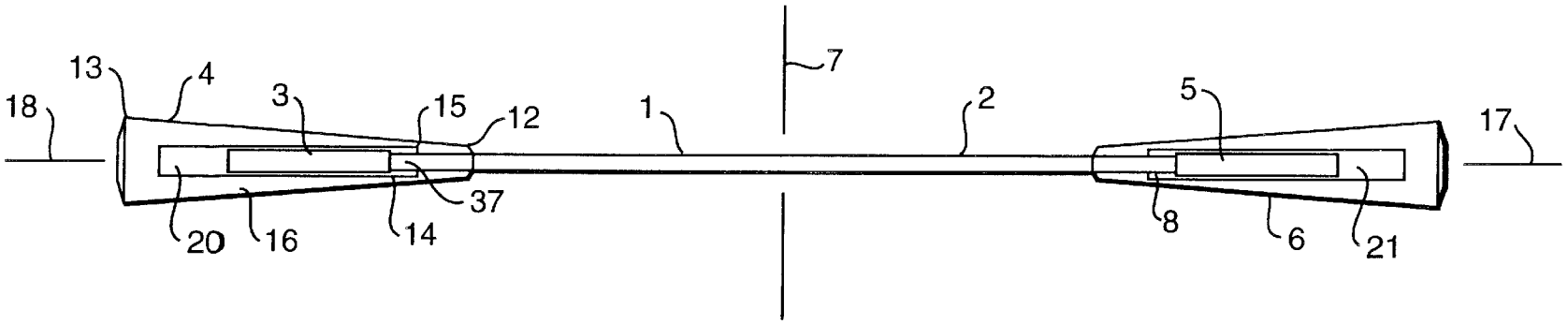
FIG. 1 is a side view of the exercise apparatus.

The exercise apparatus of this invention comprises a symmetrical rod shaped device which has a middle section or shaft having a high flexure strength of at least 500 Kpsi (100,000 pounds per square inch) up to about 2,000 Kpsi. Attached to each end of the shaft are weights which comprise most of the weight of the apparatus, at least 60%, and preferably 80%, of the total weight of the apparatus. Over each weight and a portion of each end of the shaft are flexible hand-grips adapted to be held with two hands as in a golf swing. The apparatus is adapted for exercising the human body by both a swinging action and a shoulder flexing action. The apparatus comprises an elongated generally cylindrical shaft having a length in the range of about 30 to 50 inches and a diameter in the range of about 0.25 to 2.0 inches; said generally cylindrical shaft comprising a middle section of light weight flexible material having a resistance to flexing; said generally cylindrical shaft being symmetrical about a central longitudinal axis and about a plane through the center and perpendicular to said shaft; said generally cylindrical shaft having a generally cylindrical high density material attached to each end of said middle section; said generally cylindrical shaft having a flexible hand-grip covering the generally cylindrical high density material and a portion of the shaft at each end, and said generally cylindrical high density material and said hand grips positioned so that said generally cylindrical shaft is adapted to be held by either hand-grip using two hands and is adapted to being swung while being held using two hands.

The middle section is generally cylindrical and composed of a light weight, high strength material. Generally cylindrical means the shaft is substantially longer than the cross-section diameter. In other words, an elongated shaft. The cross-section diameter can be circular, octagonal, square, or have a polygon shape which is substantially symmetrical about the center and which would coincide with the major axis of the shaft. The shaft can be a solid, hollow or composed of several layers to form a rod like structure. It can be made of one material or it can be a hollow shaft filled with another composition, it can be a solid rod covered with another material or it can be one material mixed with other components to, form a rod like shaft.

The middle section or shaft generally has a diameter in the range of about 0.25–2.0 inches and preferably 0.25–1.25 inches. The diameter will depend upon the material of which the shaft is made. For some materials, a larger diameter may be necessary to produce the desired level of flexure strength and handling characteristics. The minimum flexure strength desired is about 100 Kpsi (100,000 pounds per square inch) but may be higher for exercise where greater resistance is desired for the exercises. Upper torso exercises include placing the exercise shaft over the shoulders and behind the neck and pulling down and forward using a hand on each end of the shaft. This exercise can also be done first to one side, then to the other side. A larger diameter shaft may be desired for comfort while resting on the shoulders in performing these exercises. Where a larger diameter shaft is desired with a lower range flexure resistance, the shaft can be made of either a smaller diameter inner shaft to give the desired resistance which is covered with an outer layer of resilient or cushion material, such as plastic, rubber or leather, to give the desired diameter and make the shaft more comfortable when pulled against the neck and shoulders. Likewise, a larger diameter shaft can be produced using a hollow outer shaft filled with another material. In this embodiment the outer material could provide most of the flexure resistance and the inner material would add some strength and bending resistance to the middle section or shaft portion of the exercise apparatus. Likewise, a major portion of the flexure strength could be provided by the inner or filler material. In some cases a hollow shaft alone or one with some type of thin covering could be used.

The middle section or shaft can be made of some type of metal alloy such as steel, aluminum, titanium or maybe even a brass type alloy. One preferred embodiment uses for the shaft polymeric or resin type material. Polymeric or resin type materials are preferably filled and extruded type materials which have a flexure strength of at least 100 Kpsi. The filler material is preferably short fibers which can be readily mixed with the polymer or resin before it is extruded or formed. Particulate type fillers can also be used to increase strength and handling characteristics of the polymeric filler and rod produced. Preferred types of polymeric materials include nylon, acetalhomopolymers and co-polymers, ultra high molecular weight polyethylene and polypropylene, acrylic polymer, polyetherimide, polyether-ketone type polymers, especially a multi-ether polymer, acrylonitrile, butadiene-styrene type polymers, polyesters, polyester-vinyl polymers, polybutylene-terephthalate type polymers, polyaramid homo and copolymers and mixtures thereof, polyphenylene sulfide homo and copolymers, halogenated vinyl type polymers, polyamide-imide type polymers, polyvinylidene flouride type polymers, polyurethane polymers, phenolic type polymers and combinations thereof. Fibers which can be used as fillers to increase the flexure strength of the polymeric material include glass, carbon, nylon, polyesters, cellulose, steel, aramid, imide and combinations thereof. Particulate fillers can also be used to modify properties of the polymeric material. Particulate fillers include carbon, talc, titanium dioxide, silica, metallic powders and combinations thereof. The fibers used as fillers are generally about 0.25 to 1.0 inches long. The length will depend upon the mixing facilities used to combine the ingredients before the shaft is formed by extruding or molding the polymeric material to form the shaft. With special handling or some types of facilities, longer fibers, up to about 3 inches, can sometimes be used. Preferred types of fibers include glass, nylon, polyamide, polyaramide and combinations of these.

The middle section or shaft is preferably the longest part of the exercise shaft. The middle section length can be in the range of about 25 to 48 inches long to produce an exercise bar having an overall length in the range of about 35 to 50 inches with a total overall weight in the range of about 1.5 to 6.0 pounds. The total weight and length should be designed to accommodate the needs of the person performing the exercises. For example, a smaller person might prefer a shorter, lighter exercise shaft and a larger or more experienced person might prefer a longer and/or heavier exercise shaft. The length is selected for the exercise bar to comfortably fit over the person's shoulders and to comfortably fit the persons' swing. Heavier exercise bars are used to provide more weight for the torso exercises and swinging exercises.

The generally cylindrical high density material, referred to as a weight or weighting material, of the exercise shaft is located at each end of the middle shaft and attached to the middle shaft and hand-grip at that end of the exercise bar. The high density material is located in a generally cylindrical compartment formed by a hand-grip and one end of the middle shaft. The weight can fill the entire compartment or it can fill only a portion of the compartment or cavity. Any remaining portion of the cavity can be left empty (i.e. filled with air or another gas) or it can be filled with a lighter weight material such as wood, a polymeric material, fiber or particulate material. The high density material can be selected from an alloy of iron or steel, lead, cadmium, zinc, tin, brass, mercury, chromium, or any other heavy metallic material. The weight can be in the form of a solid rod, a high density plastic type material, metallic particles or combinations thereof. One embodiment includes metallic particles in a polymeric or resin type material. In one embodiment, weights on each end of the exercise bar are equal or balanced as are the hand-grips so that the weight of the exercise bar is balanced about the center of the exercise bar. The weight in each end is the same and each weight is in the range of about 10 to 100 ounces and preferably about 20 to 70 ounces. In another embodiment the weights are of different sizes and/or shape. For this embodiment the exercise bar is symmetrical in shape but each end carries a different weight so that different exercises could be performed by holding the different ends of the same exercise bar. For example, by gripping the exercise bar at the heavier end one and swinging the bar, one could impart greater swinging resistance to the hands, wrists, arms, shoulders, and torso than by gripping the lighter end and swinging the same exercise bar but the total centrifugal pull on the body and shoulders would be the same. In other words, the same bar would have two ranges of exercise weights for the different exercises.

The hand-grip is preferably a polymeric type such as the type used for golf clubs. It can also be made of other materials such as leather, fabric or combinations of materials. The hand-grip is preferably tapered with the smaller diameter nearer the middle of the exercise shaft. At least a portion of the hand-grip covers a portion of the shaft or middle section of the exercise bar.

The middle section of the exercise bar is selected along with the total weight of the end-weights and hand-grips to produce an exercise bar having the total weight and length desired and numerous variations will be apparent to one skilled in the art in view of this disclosure. The end-weights are attached to the middle shaft and the hand-grips are attached over the end-weights to the middle section. If the end weights are soft, plastic or even liquid in form as with mercury, some amalgams, or filled plastic weighting material, a cylindrical container or sleeve can be used to reinforce or contain this type of weighting material. The exercise bar is assembled by attaching the herein described parts so that the exercise bar has a high radius of gyration and the center of percussion for the exercise bar is located in the distal hand-grip when the exercise bar is pivoted, or swung, about the shoulders while holding the other hand-grip with both hands. This particular location of the majority of the weight of the exercise bar produces the maximum radius of gyration and consequently the maximum resistance for upper torso exercises such as rotation about the hips or shoulders with the exercise bar on the shoulders. At the same time this particular distribution of weight and strength of the exercise bar produces an exercise bar that more nearly simulates the weight distribution and swing characteristics of a golf club with one to 6 times the weight of a typical golf club.

One embodiment of the exercise bar is shown in FIG. 1. FIG. 1 shows the exercise bar 1, having a middle section 2 with its center at 7. At a first end of the middle section or shaft a weight 3, is attached to the end of the middle section 2 at point 37. Over the weight 3 and the end of the middle section 2 a hand-grip 4 is attached to both. The hand-grip is shown to taper from larger end 13 to smaller end 12. The hand-grip has a cavity defined between points 15 and 20. The weight 3, which extends from point 14 to point 16, and shaft 37 can be positioned so that the weight 3 fills cavity 20 leaving a larger space at 15, or the weight can be positioned so that cavity 20 is larger and cavity 15 is smaller or at any intermediate position. This variable allows adjustment of the length and weight distribution of the exercise bar. With uniform spacing and equal weights the exercise bar is symmetrical about central or longitudinal axis 17–18 as well as about the middle or perpendicular axis 7. The remaining portion of the weight cavity 20 or 15 in hand-grip 4 can be filled with a material such as wood or plastic. At the other end of the middle section 2, another weight 5 is attached at point 8 to the middle section 2 by any one of several methods such as by use of an adhesive or cement. If the middle section and weight are composed of suitable materials, each can be threaded so that the middle section screws into an inner sleeve formed in the end of the weight or the weight can screw into a cavity formed in the end of the shaft. For this type of threaded connection, the middle section or shaft and the weight should be made of a workable or machineable material. Suitable materials can be metal, a metallic alloy, a machineable polymer or some such composition. Over the weight 5 and end of the middle section at 8, a hand-grip 6 is attached to both. As shown, the weight 5 does not fill the entire weight cavity 21. The weight and shaft can be sized to just fill the cavity or a portion of the cavity can be left open or filled with a lighter material such as wood, polymeric material or adhesive. As shown in FIG. 1, the center 7 of the middle section is also the center of the entire exercise bar and the center of gravity of the exercise bar, if the weights are equal.

Figure 2:
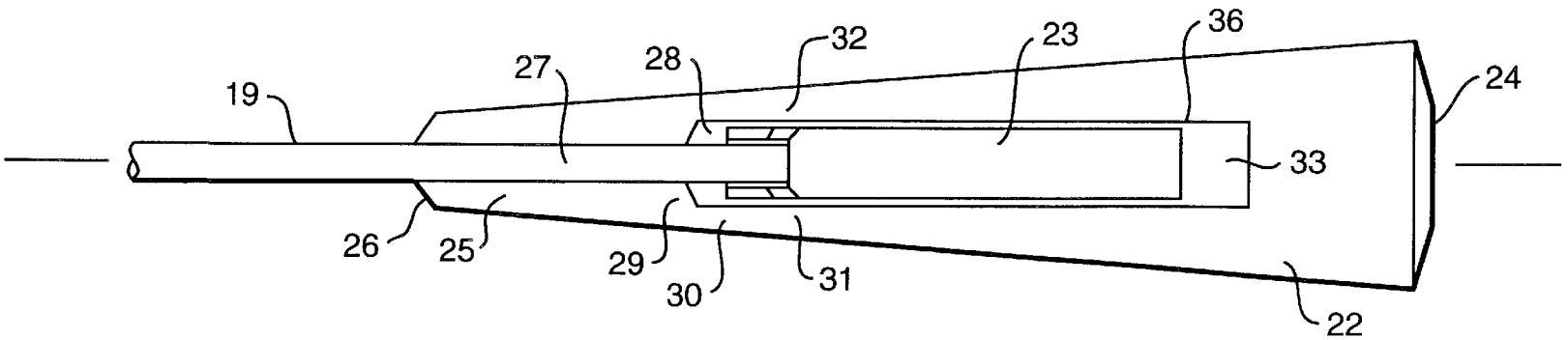
FIG. 2 is an enlarged side view of one end of the exercise apparatus.

FIG. 2 shows an enlarged version of one embodiment of the end of the middle section 19 as it is attached to weight 23 and the hand-grip 22. The hand-grip, as shown, has a portion that closely fits the middle portion or shaft 27 from point 26 to point 29. This portion of the hand-grip can be tightly fitted or cemented to the shaft. In one embodiment this portion can be fitted to slideably engage the shaft to allow the hand-grip to be moved laterally along the shaft and weight for adjustment of the length and weight distribution. The weight 23 is shown as a cylindrical metal rod having a smaller diameter cylindrical cavity 28 in one end which extends from point 30 to a depth as shown at point 31 and which is large enough to receive one end of middle section 27. The weight 23 has at least one, and in this case two, small pilot holes 32 at the end of the cavity 28, as shown at 31 and 32 which allow fluid within cavity 28 to flow out the pilot hole as the end of middle section 27 is inserted. The fluid can be air or it can be an adhesive or filler used to hold section 27 and weight 23 together and to fill the cavity in the weight and to some degree cavities 28 and 33. This method allows both the section 27 and weight 23 to be cylindrical yet have a tight bond together. FIG. 2 shows both the middle section 27 and weight 23 covered by hand grip 22 which is tapered from smaller end 25 to larger distal end 24. FIG. 2 also shows a portion of weight cavity 33 that is not filled by weight 23 which extends to point 36 within the cavity. Space 33 can be filled with air or another gas or it can be filled with a plastic material or adhesive. Typically the hand-grip 22 is also slightly tapered between point 25 and point 24 with the smaller diameter being near shaft 27. In another embodiment, the hand-grip 22 can be moved further down on the middle section 27 so that shaft 27 and weight 23 are nearer the end of cavity 33 at point 36 thereby filling the weight cavity with weight 23. In another embodiment weight 23 can be made longer to fill cavity 33 which would make the exercise bar heavier if the same density material is used for weight 23.

In one embodiment of the exercise bar the weight 23 is a steel rod approximately 10 inches long and outside diameter of about ⅝ inches and a cavity 28 having about a 0.5 inches inside diameter and a length of about 2 inches. The middle section 27 is a polyester resin rod reinforced with short glass fibers having a diameter of about 0.5 inches and a length of about 28 inches. Hand-grips 4 and 6 are made of a rubber or elastomeric composition having a length of about 10¼ inches with outside diameters of about 1.125 tapering to about 0.625 inches. The middle section 19 and weights 23 are cemented together with an epoxy type adhesive and the hand-grips 4 and 6 are cemented to the middle section 2 and weights 3 and 5 using double adhesive rubber tape and naphtha type solvent. These components are assembled to produce an exercise bar having an overall length of about 44 inches and a weight of about 32 ounces.

What is claimed is:

1. A swing-exercise device comprising:

a light-weight flexible shaft section having a high flexural modulus;

two-handed handgrips attached to each end of the shaft, the long axis of the handgrips being in-line with the longitudinal axis of the shaft whereby the device may be gripped at either end and swung as a golf club, the hand-grips being tapered with the smaller diameter end nearer the middle of the apparatus; and weights within each handgrip such that at least 60% of the weight of the device is concentrated in the handgrips with each weight within the handgrips being substantially equal;

the device having an overall length of 35–50 inches and being symmetrical in proportion about its longitudinal axis and being symmetrical and balanced about an axis perpendicular to the longitudinal axis.

2. An apparatus of claim 1 wherein each weight is attached to the light-weight flexible shaft section in a manner such that the apparatus is an elongated generally cylindrical shaft which is symmetrical about the longitudinal axis.

3. An apparatus of claim 1 wherein the light-weight flexible shaft section comprises one or more of the materials selected from the group consisting of a metal alloy, a polymeric material, a resin type material, or combinations thereof.

4. An apparatus of claim 1 wherein the light-weight flexible shaft section consisting of polymeric material containing fillers selected from fiber fillers, particulate fillers and combinations thereof.

5. An apparatus of claim 1 wherein the light-weight flexible shaft section comprises a polymeric material selected from the group consisting of nylon, acetal-homopolymers, acetal-co-polymers, acrylic polymer, poly etherimide, polyether-ketone polymers, acrylonitrile, butadiene-styrene polymers, polyesters, polyester-vinyl polymers, polybutylene-terephthalate polymers, polyaramid-homopolymers, polyaramid-copolymers, polyphenylene sulfide homopolymers, polyphenylene sulfide copolymers, halogenated vinyl polymers, polyamide-imide polymers, polyvinylidene flouride polymers, polyurethane polymers, phenolic polymers and combinations thereof.

6. An apparatus of claim 1 wherein the light-weight flexible shaft section comprises polymeric material containing fiber fillers.

7. An apparatus of claim 1 wherein the light-weight flexible shaft section comprises polymeric material containing particulate fillers.

8. An apparatus of claim 1 wherein each end of the light-weight flexible shaft section fits into a cavity formed in the end of each weight so that the apparatus is symmetrical about a central longitudinal axis.

9. An apparatus of claim 1 wherein the light-weight flexible shaft section is attached to each weight at each end by the light-weight flexible shaft section slideably engaging each weight in a cavity formed in the end of each weight so that the apparatus is substantially symmetrical about a central longitudinal axis.

* * * * *